US009021623B2

(12) United States Patent
Kuster et al.

(10) Patent No.: US 9,021,623 B2
(45) Date of Patent: May 5, 2015

(54) DEVICE FOR PREPARING SHOWER WATER FOR A WATER CLOSET HAVING AN UNDER-SHOWER AND METHOD FOR OPERATING SUCH A DEVICE

(75) Inventors: Rolf Kuster, Rapperswil (CH); Marco Oberholzer, Eschenbach (CH); Armin Gierer, Mosnang (CH)

(73) Assignee: Geberit International AG, Jona (CH)

( * ) Notice: Subject to any disclaimer, the term of this patent is extended or adjusted under 35 U.S.C. 154(b) by 1118 days.

(21) Appl. No.: 12/976,296

(22) Filed: Dec. 22, 2010

(65) Prior Publication Data

US 2011/0154564 A1 Jun. 30, 2011

(30) Foreign Application Priority Data

Dec. 24, 2009 (EP) ..... 09405232

(51) Int. Cl.

| | |
|---|---|
| ***A47K 3/022*** | (2006.01) |
| ***F24D 17/00*** | (2006.01) |
| ***F24H 1/12*** | (2006.01) |
| *E03D 9/08* | (2006.01) |

(52) U.S. Cl.

CPC ..... *F24D 17/0089* (2013.01); *F24D 17/0073* (2013.01); *F24H 1/121* (2013.01); *E03D 9/08* (2013.01)

(58) Field of Classification Search

CPC ..... E03D 9/08

USPC ..... 4/420.2, 420.4

See application file for complete search history.

(56) References Cited

U.S. PATENT DOCUMENTS

| | | | | |
|---|---|---|---|---|
| 3,154,793 | A * | 11/1964 | Congdon | 4/420.2 |
| 3,594,826 | A | 7/1971 | Maurer | |
| 4,123,807 | A | 11/1978 | Oguma et al. | |
| 7,500,275 | B2 * | 3/2009 | Kim | 4/420.2 |
| 8,495,770 | B2 * | 7/2013 | Koga et al. | 4/420.4 |

FOREIGN PATENT DOCUMENTS

| | | |
|---|---|---|
| DE | 26 30 671 A1 | 1/1977 |
| EP | 1 548 376 A1 | 6/2005 |
| WO | 2006/079231 A1 | 8/2006 |

* cited by examiner

*Primary Examiner* — Tuan N Nguyen

(74) *Attorney, Agent, or Firm* — Sughrue Mion, PLLC

(57) ABSTRACT

The device has a line arrangement (2), which possesses an inlet (3) connectable to a supply line and an outlet (4) connectable to a shower arm (5). A heating element (6) serves for the provision of warm water. An energy store (7, 8) is provided, with which the power range for the provision of shower water can be extended. The heating element (6) for the provision of warm water is, in particular, a continuous-flow heater. The energy store (7, 8) is, in particular, a thermal, electrical, electrochemical or chemical energy store. During the shower process, the energy store is available as an additional energy source for the preparation of shower water.

20 Claims, 1 Drawing Sheet

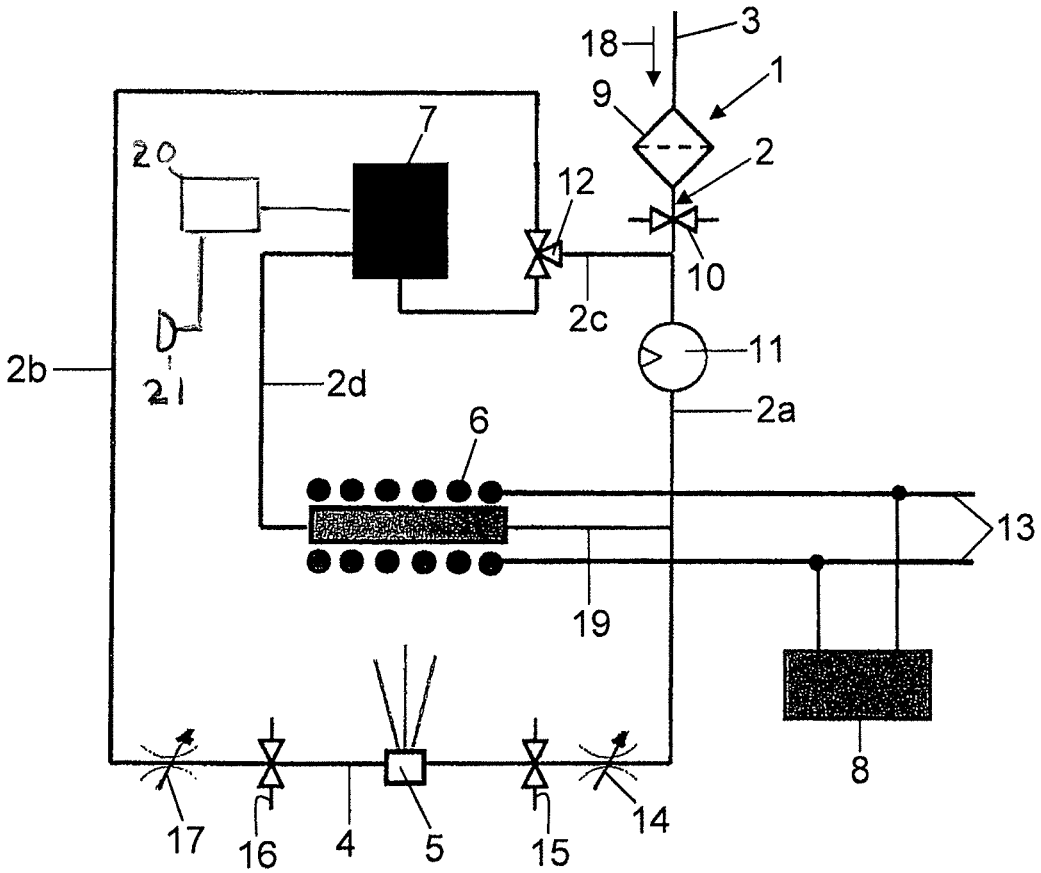
3
18
1
9
2
7
20
12
10
2c
11
2b
21
2d
2a
6
13
19
8
17
16
4
5
15
14

DEVICE FOR PREPARING SHOWER WATER FOR A WATER CLOSET HAVING AN UNDER-SHOWER AND METHOD FOR OPERATING SUCH A DEVICE

The invention relates to a device for preparing shower water for a water closet having an under-shower, comprising a line arrangement, which has an inlet connectable to a supply line and an outlet connectable to a shower arm, and comprising a heating element for the provision of warm water.

Such devices have long been known in the prior art. A water closet having an under-shower or a warm water shower makes the use of toilet paper largely redundant. In practice, such water closets have already proved extremely successful. The shower water must be warmed to body temperature to enable it to be delivered from the shower arm. For this, a warm water tank as disclosed in connection with the device according to DE-A-26 30 671, in particular, is suitable. In this warm water tank, a heating device is arranged for the warming of water, which heating device is coupled to a thermostat. With the aid of the thermostat, the water temperature is maintained at the desired level of, for example, 40° C. The temperature level is adjustable.

WO 2006/079231 has disclosed a device in which a water boiler is provided for the preparation of body-warm shower water. The warm water boiler possesses thermostatically controlled heating means. In the boiler, the boiler water is heated at fixed-set intervals momentarily to at least 70° C. and is otherwise permanently maintained at least 55° C. The momentary heating to at least 70° C. is here provided to reduce the number of germs and bacteria in the shower water. In order to attain a body-warm temperature, the shower water is mixed with mains water via a mixing valve in front of the discharge nozzle of the under-shower.

If the water is prepared in a warm water tank, with a flow rate of 5.5 l/min and a water temperature of 37° C., a shower time of about 20 seconds can be expected. Following this shower time, the water temperature then gradually decreases. With a larger warm water tank and a correspondingly higher energy consumption, a longer shower time would in principle be possible. For spatial reasons, however, a larger water tank is not possible or, at least, not desirable. A substantially higher energy consumption should also be avoided.

The object of the invention is to provide a device of the said type which allows a longer shower time with warm water.

In a device of the generic type, the object is achieved by virtue of the fact that it has an energy store with which the power range for the provision of shower water can be extended. In this energy store, a set quantity of energy is temporarily stored. During the shower process, this energy store is available as an additional energy source for the preparation of the shower water. The energy store supplements, for example, a continuous-flow heater. During the shower process, the continuous-flow heater can then be fed with the available power, for example, of a connected power supply network. The water of the continuous-flow heater can then be mixed, for example, with the water of a warm water tank which forms the energy store. This warm water tank can be maintained at a higher temperature of, for example, higher than 40° C. and lower than 90° C. Through the combination of such a continuous-flow heater and a warm water store, a shower duration of one minute, with a flow rate of 5.5 l/min and a shower temperature of 37° C., for example, is possible. Instead of an energy store in the form of a warm water tank, an energy store in the form of an electrical, electrochemical or chemical energy store is also conceivable, for example. The energy store could be a storage battery, for example, which is connected to an electrical mains network and the power of which increases during the shower process. Following a shower process, the storage battery is then recharged via the mains. Energy stores in which a chemical or electrochemical process, where necessary, releases energy are also possible.

According to one refinement of the invention, it is provided that the energy store is a high-temperature store in which water can be provided at a temperature which is higher than the temperature of body-warm water. The intended temperature of the high-temperature store preferably lies within the range from about 40° C. to 90° C. Through the admixture of mains water, the temperature is then lowered to a body-tolerable temperature of, for example, 37° C.

According to one refinement of the invention, it is provided that the line arrangement has a water circuit which can be connected to the under-shower such that the under-shower can be fed unwarmed water via a first line branch and warmed water via a second line branch. The warmed water and the unwarmed water can be mixed beforehand or in the shower arm, so that body-warm shower water finally leaves the shower arm. The unwarmed water can further be used to extend the shower arm and thus as a drive means.

According to one refinement of the invention, the first line branch is connected to a continuous-flow heater. According to one refinement of the invention, in the second line branch is arranged a warm water store, which is connected to the first line branch via a switching valve. In the shower process, the water warmed in the continuous-flow heater can then be supplied to the warm water store, which at the same time delivers water which is mixed with water from the first line branch. This allows a particularly energy-saving operation. In quite general terms, a longer shower duration without a significant increase in necessary energy is possible.

The invention further relates to a method for operating a device according to the invention. In this method, it is provided, in particular, that the device in the idle state is in the dormant state and that it is monitored with regard to a user. If a user is detected, then the dormant state is terminated and, prior to the delivery of shower water, the energy store can be charged. In the case of a warm water tank, the shower water is warmed in this or brought to a higher temperature. The energy supply can be realized here, for example, via an electrical supply network. The heating system can in this case operate under full load. During the shower process, a regulated mixture of store water from the warm water tank and water from the continuous-flow heater preferably takes place here. The heating system can continue to operate under full load. An admixture of water which has not previously been warmed is also conceivable here. If the energy store is a storage battery, for example, then it is discharged during the shower process, so that the power of the mains network is supported by the power of the storage battery. In this case, the water is warmed, for example, solely in the continuous-flow heater. Compared with the prior art, a longer shower duration can thus be achieved using the same mains power, since energy is provided from the storage battery.

Following the shower process, the energy store can be recharged. In the case of a warm water store, the water temperature can be increased and maintained at a set temperature therein by means of a thermostat. In the case of a storage battery, this is recharged via the mains. An embodiment having a plurality of energy stores, for example a warm water store and a storage battery, is also conceivable.

Further advantageous features emerge from the dependent patent claims, the following description and the drawing.

Illustrative embodiments of the invention are explained below with reference to the single FIGURE. The FIGURE shows schematically an illustrative embodiment of the device according to the invention.

The inventive device 1 which is shown in the single FIGURE possesses a line arrangement 2 having an inlet 3. This inlet 3 is connectable to a supply line (not represented here), for example a water pressure line. The connection can be realized, for example, via a screw connection or the like (not shown here). The direction of flow in which water can be supplied to the line arrangement is indicated with the arrow 18. After the inlet is arranged a filter 9, in which the supplied water is filtered. The filter 9 can be a water filter which is known per se. After the filter 9, there is arranged in the line arrangement 2 a valve 10, in particular a shut-off valve. With this, the supply of water to the elements mentioned further below can be interrupted.

The line arrangement 2 forms after the valve 10 a water circuit. This possesses a first line branch 2*a*, in which is arranged a pump 11, which is a water pump that is known per se and with which line water can be supplied to a shower arm 5 of an under-shower, which latter is not shown further here. Between the pump 11 and the shower arm 5 are arranged, as shown, a regulator 14 and a further valve 15. The valve 15 is preferably a regulating valve, with which the supply of water to the shower arm 5 can be regulated.

The said water circuit further possesses a second line branch 2*b*, which after the pump 11 is connected to the first line branch 2*a* by a connecting line 19. This connecting line 19 leads to a heating element 6, which, for example and preferably, is a continuous-flow heater. The continuous-flow heater is connected here to an electrical supply line 13. This line 13 is, for example, an electrical supply network, or another suitable energy source. The heating element 6 is connected to an energy store 7 by a further connecting line 2*d*. The water warmed in the heating element 6 can thus be supplied to the energy store 7 via this connecting line 2*d*.

The energy store 7 is here, for example a warm water store or a boiler, which is here likewise connected to the supply line 13 and in which, for example, water can be warmed and stored via an electrical heating element. The energy store 7 is preferably thermally insulated, so that the energy loss can be reduced. In the energy store 7, the water can be warmed to and maintained at, for example, a temperature between about 40 to 90° C. Via a temperature regulator (not shown here), a predetermined temperature can be maintained. Suitable control means for this purpose are known per se to the person skilled in the art.

The energy store 7 is connected to a switching valve 12, which is, for example, a three-way valve. This valve 12 is connected here to the inlet 3 by a further connecting line 2*c*. Via the connecting line 2*c* and the switching valve, water can be supplied directly to the energy store 7. The energy store 7 can thus be fed, on the one hand, warmed water via the connecting line 2*d* and, on the other hand, unwarmed water or water from the inlet 3 via the switching valve 12. The switching valve 12 is further connected to the shower arm 5 by the second line branch 2*b*. Between the switching valve 12 and the shower arm 5 are arranged a regulator 17 and a valve 16. Warm water can thus be supplied in a regulated manner to the shower arm 5 via the second line branch 2*b*. This warm water can be mixed with the water from the first line branch 2*a*. Sensors for determining the corresponding water temperatures are provided, but are not shown here. A suitable control device 20, which regulates the said valves as well as the heating element 6 and the energy store 7, is shown. Actuating means with which the shower process can be triggered are likewise not shown, nor are they known per se. The triggering can be realized, for example, via a push button or in a contact-free manner.

The method according to the invention is explained in greater detail below.

In the idle state, the energy store 7 is filled with water. The valve 10 is closed and the device 1 is in a dormant mode. In the energy store 7, a set temperature, for example 40° C. or less, is maintained. During the idle state, any use is monitored, for example, via a sensor 21 in a toilet seat. If a user is detected, then the water in the energy store 7 is warmed, so that the temperature finally lies within the range between about 40° C. and 90° C. The energy store 7 is thus charged. The charging is realized here preferably under full load. The energy store 7 is charged in a comparatively short time and the temperature increased to the desired value. At the same time or alternatively, the energy store 8 can be charged. If this is a storage battery, then this is charged correspondingly via the supply lines 13.

If the shower process is triggered by the user, then the switching valve 12 is switched and the pump 11 is activated. Likewise, the heating element 6 is switched on. In the heating element, water is heated and this is supplied to the energy store 7. The water from the heating element 6 is hereupon mixed with the water of the energy store 7. In order to attain the desired temperature for the shower process, comparatively cold water can be supplied by means of the switching valve 12 via the connecting line 2*c*. Via the second line branch 2*b*, water now makes its way to the shower arm 5. The valve 16 is opened and regulated correspondingly. At the same time, comparatively cold water can also be supplied to the shower arm 5 via the first line branch 2 and mixed in. The water from the second line branch 2*a* can, however, also be used to move the shower arm 5 into the stand-by position. This is likewise regulated by means of the valve 15. The water from the second line branch 2*a* thus serves in this case as a drive means for displacing the shower arm 5. Hydraulically movable shower arms 5 are known per se to the person skilled in the art. During the shower process, the heating system preferably continues to operate in full load. The shower process is interrupted by the user or automatically. Then the energy store 7 is recharged and regulated to a specific temperature. Alternatively or at the same time, the energy store 8 can likewise be charged. The device 1 is finally restored to dormant mode. The device 1 is now ready again for a further shower process.

REFERENCE SYMBOL LIST

1 device
2 line arrangement
2*a* first line branch
2*b* second line branch
2*c* connecting line
2*d* connecting line
3 inlet
4 outlet
5 shower arm
6 heating element
7 energy store
8 energy store
9 filter
10 valve
11 pump
12 switching valve
13 electrical supply lines
14 regulator
15 valve

16 valve
17 regulator
18 arrow
19 connecting line

The invention claimed is:

1. A device for preparing shower water for a water closet having an under-shower, comprising a line arrangement, which has an inlet connectable to a supply line and an outlet connectable to a shower arm, and comprising:
- a heating element for the provision of warm water,
- an energy store with which a power range for the provision of shower water can be extended, and
- a control device, said control device being operative:
  - to detect the presence of a user,
  - following detection of a user and prior to delivery of shower water, to charge the energy store; and
  - following use, to switch the device for preparing shower water into a dormant state and monitor said device for preparing shower water with regard to use.

2. The device according to claim 1, wherein the heating element for the provision of warm water is a continuous-flow heater.

3. The device according to claim 1, wherein the energy store comprises a thermal, electrical, electrochemical or chemical energy store.

4. The device according to claim 1, wherein the energy store comprises a high-temperature store in which water can be provided at a temperature which is higher than the temperature of body-warm water.

5. The device according to claim 1, wherein the line arrangement has a water circuit which can be connected to the under-shower such that the under-shower can be fed substantially unwarmed water via a first line branch and warmed water via a second line branch.

6. The device according to claim 5, wherein the shower arm is driven, in particular is extended, with water from the first line branch.

7. A method for operating a device for preparing shower water for a water closet having an under-shower, comprising a line arrangement, which has an inlet connectable to a supply line, an outlet connectable to a shower arm, a heating element for the provision of warm water, an energy store with which a power range for the provision of shower water can be extended and a control device, comprising:
- detecting a user, and
- using the device for preparing shower water to provide shower water to the water closet in a shower process,
- wherein the device for preparing shower water, following use, is switched into a dormant state and is monitored with regard to use, and
- wherein following detection of a user and prior to delivery of shower water, the energy store is charged.

8. The method according to claim 7, wherein the heating element for the provision of warm water is a continuous-flow heater.

9. The method according to claim 7, wherein during a shower process, water from the heating element is mixed in the energy store with substantially colder water.

10. The method according to claim 7, wherein the shower arm is driven, in particular is extended, with water from the first line branch.

11. A method of operating a device for preparing shower water for a water closet having an under-shower, comprising a line arrangement, which has an inlet connectable to a supply line, an outlet connectable to a shower arm, a heating element for the provision of warm water, an energy store with which a power range for the provision of shower water can be extended and a control device, comprising:
- using the device for preparing shower water to provide shower water to the water closet in a shower process,
- wherein, following the shower operation, charging the energy store and, thereafter, switching the device for preparing shower water into a dormant state and monitoring the device for preparing shower water with regard to use.

12. The method according to claim 11, wherein during a shower process, water from the heating element is mixed in the energy store with substantially colder water.

13. The device according to claim 11, wherein the shower arm is driven, in particular is extended, with water from the first line branch.

14. The device according to claim 11, wherein the heating element for the provision of warm water is a continuous-flow heater.

15. A device for preparing shower water for a water closet having an under-shower, comprising a line arrangement, which has an inlet connectable to a supply line and an outlet connectable to a shower arm, and comprising:
- a heating element for the provision of warm water,
- an energy store with which a power range for the provision of shower water can be extended, and
- a control device, said control device being operative:
  - to detect an end to shower operation;
  - following the shower operation, to charge the energy store, and
  - thereafter, to switch the device for preparing shower water into a dormant state and monitor the device for preparing shower water with regard to use.

16. The device according to claim 15, wherein the heating element for the provision of warm water is a continuous-flow heater.

17. The device according to claim 15, wherein the energy store comprises a thermal, electrical, electrochemical or chemical energy store.

18. The device according to claim 15, wherein the energy store comprises a high-temperature store in which water can be provided at a temperature which is higher than the temperature of body-warm water.

19. The device according to claim 15, wherein the line arrangement has a water circuit which can be connected to the under-shower such that the under-shower can be fed substantially unwarmed water via a first line branch and warmed water via a second line branch.

20. The device according to claim 15, wherein the shower arm is driven, in particular is extended, with water from the first line branch.

* * * * *